US009709297B2

(12) United States Patent
Hatton

(10) Patent No.: US 9,709,297 B2
(45) Date of Patent: Jul. 18, 2017

(54) INLET AIR FLOW GUIDE FOR ACDX FAN COIL

(71) Applicant: David L. Hatton, Houston, TX (US)

(72) Inventor: David L. Hatton, Houston, TX (US)

( * ) Notice: Subject to any disclaimer, the term of this patent is extended or adjusted under 35 U.S.C. 154(b) by 481 days.

(21) Appl. No.: 14/061,402

(22) Filed: Oct. 23, 2013

(65) Prior Publication Data

US 2014/0048231 A1 Feb. 20, 2014

Related U.S. Application Data

(62) Division of application No. 13/540,403, filed on Jul. 2, 2012, now Pat. No. 8,567,205, which is a division of application No. 12/851,744, filed on Aug. 6, 2010, now Pat. No. 8,220,281.

(60) Provisional application No. 61/232,000, filed on Aug. 6, 2009.

(51) Int. Cl.

| | |
|---|---|
| ***F25D 17/06*** | (2006.01) |
| ***F25B 39/04*** | (2006.01) |
| ***F24F 13/08*** | (2006.01) |
| ***F24F 1/46*** | (2011.01) |
| ***F24F 1/50*** | (2011.01) |
| ***F24F 13/20*** | (2006.01) |

(52) U.S. Cl.

CPC ..... *F24F 13/08* (2013.01); *F24F 1/46* (2013.01); *F24F 1/50* (2013.01); *F24F 13/20* (2013.01)

(58) Field of Classification Search

CPC ..... F24F 1/46; F24F 1/48; F24F 1/50; F24F 13/20; F24F 13/08

USPC ..... 62/428, 506, 507

See application file for complete search history.

(56) References Cited

U.S. PATENT DOCUMENTS

| | | | |
|---|---|---|---|
| 1,950,344 | A | 3/1934 | Williams |
| 2,711,086 | A | 6/1955 | Eilers |
| 2,711,088 | A | 6/1955 | Hess |
| 2,852,181 | A | 9/1958 | Kline et al. |
| 3,416,329 | A | 12/1968 | George |
| 3,659,432 | A | 5/1972 | Selhost |
| 5,117,656 | A | 6/1992 | Keck et al. |
| 5,158,486 | A | 10/1992 | Tamame |
| 5,295,531 | A | 3/1994 | Tsunekawa et al. |

(Continued)

FOREIGN PATENT DOCUMENTS

| | | |
|---|---|---|
| JP | 10148135 | 5/1998 |
| JP | 2002130784 | 5/2002 |
| KR | 2006076484 | 3/2006 |

*Primary Examiner* — Ryan J Walters
*Assistant Examiner* — Joseph Trpisovsky
(74) *Attorney, Agent, or Firm* — Daniel N. Lundeen; Lundeen & Lundeen PLLC

(57) ABSTRACT

An inlet air flow guide for a condensing unit of an air cooled direct expansion (ACDX) air conditioning unit. The flow guide has a panel having at least a portion spaced from a surface of the condensing unit to define a plenum for cooling air to enter the condensing unit from one side. A condensing unit of an ACDX air conditioning unit has a refrigerant cooling coil disposed in an opening, and the inlet air flow guide defines a plenum to provide an air flow passage to the opening from one side thereof. According to a method, the inlet air flow guide is installed onto the condensing unit of an ACDX air conditioning unit, wherein a panel of the flow guide has at least a portion spaced from a surface of the condensing unit to define a plenum for cooling air to enter the condensing unit from one side.

11 Claims, 8 Drawing Sheets

(56) References Cited

U.S. PATENT DOCUMENTS

| | | | | |
|---|---|---|---|---|
| 7,146,825 | B2 * | 12/2006 | Seo | 62/428 |
| 7,191,616 | B2 | 3/2007 | Kim et al. | |
| 7,752,863 | B2 * | 7/2010 | Kim et al. | 62/291 |
| 8,220,281 | B2 | 7/2012 | Hatton | |
| 2002/0157415 | A1 | 10/2002 | Liu | |
| 2004/0244409 | A1 | 12/2004 | Kim et al. | |
| 2005/0120738 | A1 * | 6/2005 | Chun et al. | 62/455 |
| 2009/0077988 | A1 | 3/2009 | Ishikawa et al. | |

* cited by examiner

INLET AIR FLOW GUIDE FOR ACDX FAN COIL

CROSS REFERENCE TO RELATED APPLICATION(S)

This application is a continuation of U.S. Ser. No. 13/540,403, which is a divisional of U.S. Ser. No. 12/851,744, now U.S. Pat. No. 8,220,281 issued Jul. 17, 2012, which claims the benefit of and priority to U.S. provisional application 61/232,000, filed Aug. 6, 2009.

STATEMENT REGARDING FEDERALLY SPONSORED RESEARCH OR DEVELOPMENT

Not applicable

THE NAMES OF PARTIES TO A JOINT RESEARCH AGREEMENT

Not applicable

INCORPORATION BY REFERENCE OF MATERIAL SUBMITTED ON A COMPACT DISC

Not applicable

BACKGROUND OF THE INVENTION (1) Field of the Invention

The invention is related in general to air-cooled heating, ventilation and air conditioning (HVAC) fan coil units.

(2) Description of Related Art Including Information Disclosed Under 37 CFR 1.97 and 1.98

Air cooled direct expansion (ACDX) units are common in residential heating, ventilation and air conditioning (HVAC) applications and buildings of less than 650 square meters (7000 square feet). In the split system 100 illustrated in FIG. 1, the fan 102 and evaporator coil 104 of the air handling unit (AHU) 106 are typically located inside the building, e.g., in a mechanical closet, while the condensing unit (CU) 108 is located outside the air conditioned space.

The CU 108 houses a compressor 110, DX valve 112, CU fan 114 and cooling coil 116. The cooling coil 116 is typically located in fenestrations on three or four sides in a square or rectangular CU plan, depending on manufacturer, and can also be circular where the CU plan is circular. In package units (not shown) which are typically roof mounted, the AHU and CU are integrated into a single exterior unit wherein the supply and return ducts pass directly through the roof to the unit.

In operation, cold refrigerant is supplied to the evaporator coil 104, and the AHU fan 102 blows air across the evaporator coil 104, cooling the air that is circulated into the rooms via supply air duct 118 and return air duct 120. The warm refrigerant from the evaporator coil 104 is compressed at compressor 110, cooled in the cooling coil 116, expanded across DX valve 112 and supplied to the evaporator coil 104 to complete the cycle.

The cooling coil 116 is typically provided with extended surfaces such as fins, over which air is drawn by the CU fan 114 to dissipate the heat collected in the refrigerant during the cooling cycle, and the hot air is exhausted above the CU 108 by the centrally located, top-mounted fan 114. The unit 100 is typically thermostatically controlled whereby the unit 100 is cycled on when the temperature of the room air exceeds a set point, and cycled off when the temperature is below the set point. The rate of refrigerant cooling is largely a function of the temperature of the air being pulled across the coil 116, and the on cycle time depends in turn on how quickly the unit shut off set point is satisfied.

The outside CU 108 in the ACDX unit 100 is typically installed where cooling air is hotter than expected and/or cooling air flow is restricted based on the congested characteristics or orientation of the install and hot exhaust air can recirculate to the intake. Although manufacturers of ACDX units generally recommend 450 mm (18 in.) clearance around the unit to the nearest structure, these install guidelines are frequently not followed, in many cases due to geometric constraints at the installation location, and cooling air flow can be restricted or blocked from entering portions of the condenser coil.

Even where the spacing recommendations are followed there can be an issue with unit placement. For example, where the compressor unit is installed close to the building, the upward exhaust stream can impinge on an eave and be directed back down toward the CU 108, or there may be Coanda effects. Where there are multiple ACDX units installed, the issues become worse. Often these units sit so close together that air volume is limited, and the intake air temperature is higher than desired, and sometimes even hotter than the temperature for which the unit is designed to achieve boiler plate unit design output. In these situations, the CU fan 114 may provide an inadequate cooling air velocity for the required temperature drop ($\Delta T$) across the coil 116 to properly cool, resulting in a drop in efficiency and an excessively long on cycle.

The HVAC industry is constantly seeking simple, effective and low-cost ways to improve the design and efficiency of HVAC ACDX units and their installations.

BRIEF SUMMARY OF THE INVENTION

The present invention improves the efficiency of a heating, ventilation and air conditioning (HVAC) air cooled direct expansion (ACDX) unit through the use of a flow router in the approach of the cooling air to the cooling coil of the compressor unit to improve the velocity and/or temperature of the cooling air that is drawn across the cooling coil. In various embodiments, the flow router for the intake air requires no power source, is easily installed as a retrofit or in original equipment, and is especially beneficial when the compressor unit is installed in a confined space and/or multiple units are installed close to each other.

In an embodiment, an inlet air flow guide for a condensing unit of an air cooled direct expansion air conditioning unit comprises a panel having at least a portion spaced from a surface of the condensing unit to define a plenum for cooling air to enter the condensing unit from one side. In an embodiment, when the condensing unit has a rectangular plan with refrigerant cooling coils at four sides, the inlet air flow guide is secured to the unit at three sides and the remaining side is open. In an embodiment, the plenum is U-shaped. In an embodiment, the plenum comprises intake openings at opposite ends adjacent the open side of the condensing unit.

In an embodiment, a ceiling, a floor or a combination thereof are disposed between the top and bottom, respectively of a generally vertical panel and the surface of the condensing unit. In an alternate embodiment, the inlet air flow guide comprises a convex panel.

In an embodiment, in a condensing unit of an air cooled direct expansion air conditioning unit comprising a housing, a refrigerant cooling coil disposed in an opening of the housing and an exhaust fan to draw air through the opening across the coil and discharge the air above the housing, the invention is characterized by an inlet air flow guide defining a plenum to provide an air flow passage to the opening from one side thereof. In an embodiment, the housing is circular. In another embodiment, the housing has four sides each with refrigerant coil disposed in a respective louvered opening thereof, wherein the plenum is in fluid communication with the louvered openings at a plurality of the sides. In an embodiment, the plenum is U-shaped to supply cooling air to three of the sides and comprises inlet air openings at either end adjacent to the fourth side.

In an embodiment, the plenum comprises a generally vertical wall having a top and bottom spaced opposite the opening, and one or both of a ceiling and a floor extending from the respective top or bottom to the housing. In an embodiment, the plenum partially covers the opening, for example, where the plenum wall has a height less than a height of the housing and the ceiling and floor, if present, are spaced below and above upper and lower ends of the housing, respectively.

In an embodiment, a method comprises installing an inlet air flow guide onto a condensing unit of an air cooled direct expansion air conditioning unit, wherein the inlet air flow guide comprises a panel having at least a portion spaced from a surface of the condensing unit to define a plenum for cooling air to enter the condensing unit from one side. In an embodiment, the condensing unit is located where air flow to the condensing unit is restricted, and the inlet air flow guide installation improves the cooling air flow to the condensing unit.

In an embodiment, prior to the installation, the condensing unit is situated to recirculate relatively hot exhaust air to enter the condensing unit, and the installation of the inlet air flow guide inhibits the recirculation to lower the temperature of the cooling air entering the condensing unit. In an embodiment, the condensing unit is a first one of first and second condenser units situated with the second condensing unit opposite the surface of the first condensing unit, whereby the inlet air flow guide is installed opposite the second condensing unit.

In an embodiment, the method further comprises installing a said air flow guide on a surface of the second condensing unit opposite the first condensing unit. In an embodiment, the condensing unit is one of a plurality of condensing units situated near each other and a like plurality of the inlet air flow guides is installed on the plurality of condensing units. In an embodiment, the inlet air flow guides are installed on opposing surfaces of adjacent condensing units.

DETAILED DESCRIPTION OF THE INVENTION

Figure 1:
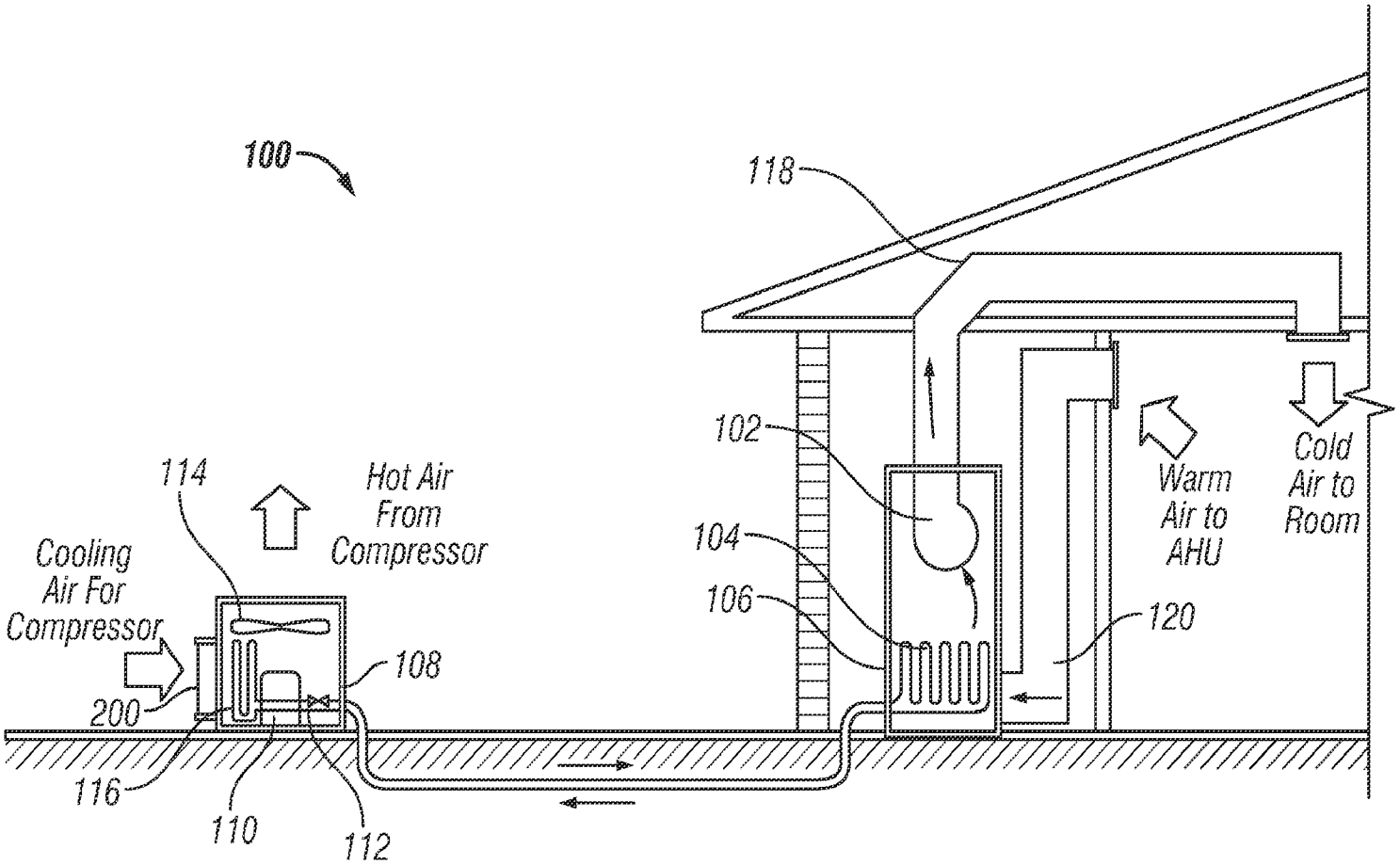
FIG. 1 is a schematic diagram of a typical air cooled direct expansion (ACDX) unit in a heating, ventilation and air conditioning (HVAC) application, showing the installation of an inlet air flow guide according to an embodiment.
Figure 2:
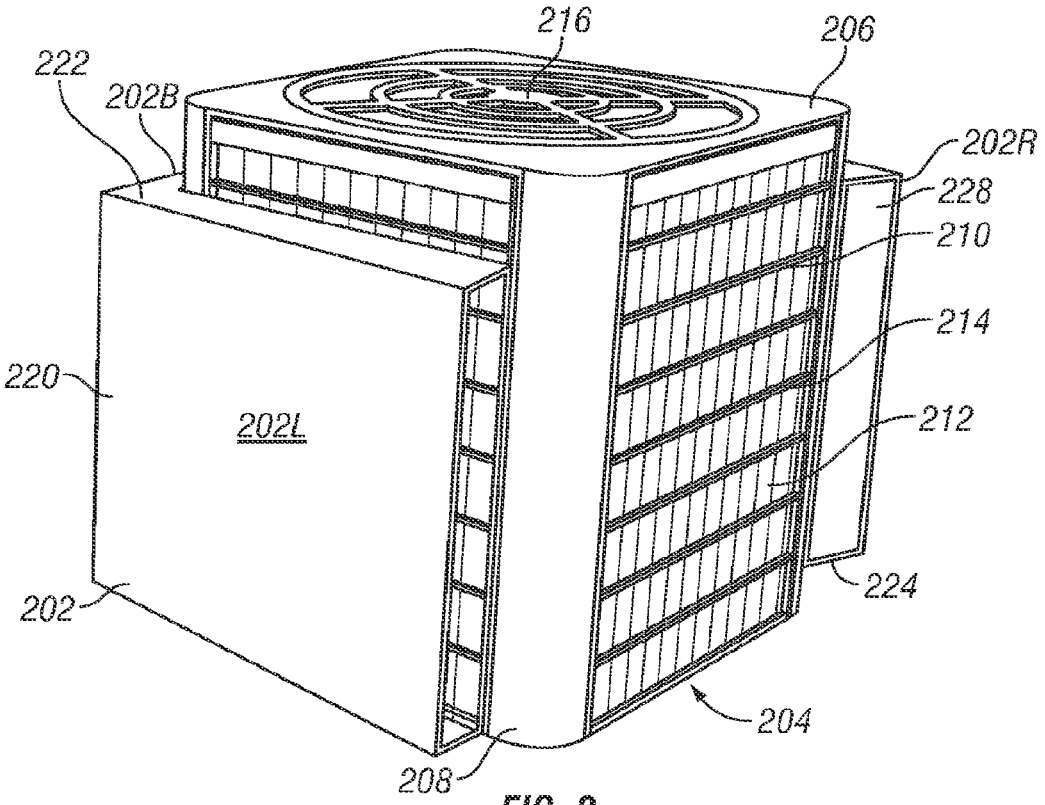
FIG. 2 is a perspective view of the compressor unit of an ACDX unit incorporating an inlet air flow router according to an embodiment.
Figure 3:
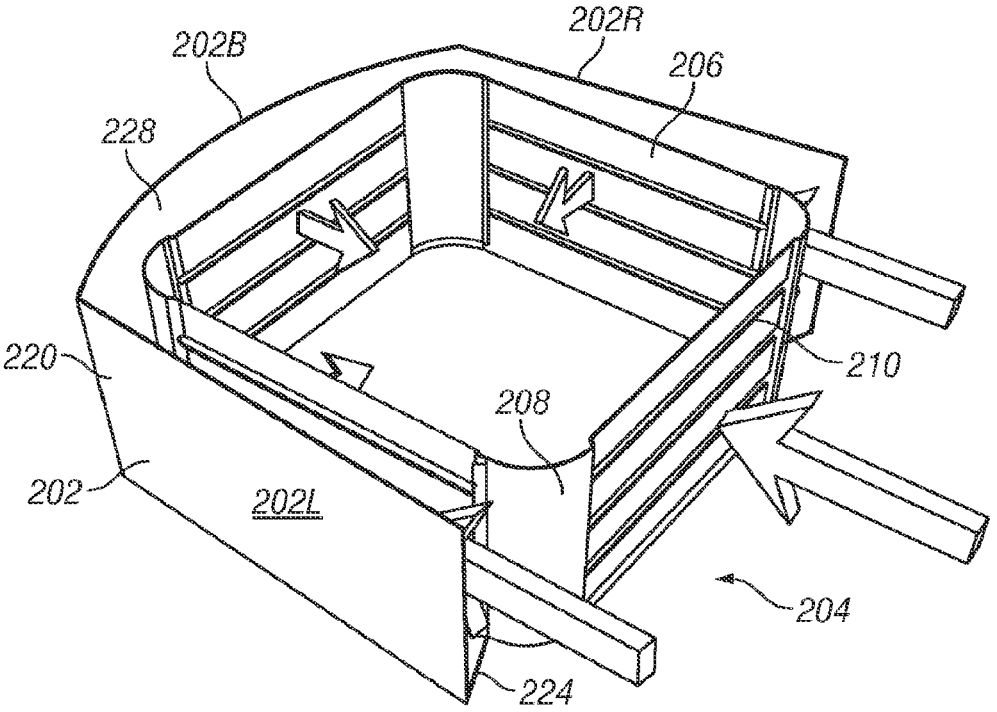
FIG. 3 is a cross sectional view of the compressor unit of FIG. 2 as seen along the lines 3-3.
Figure 4:
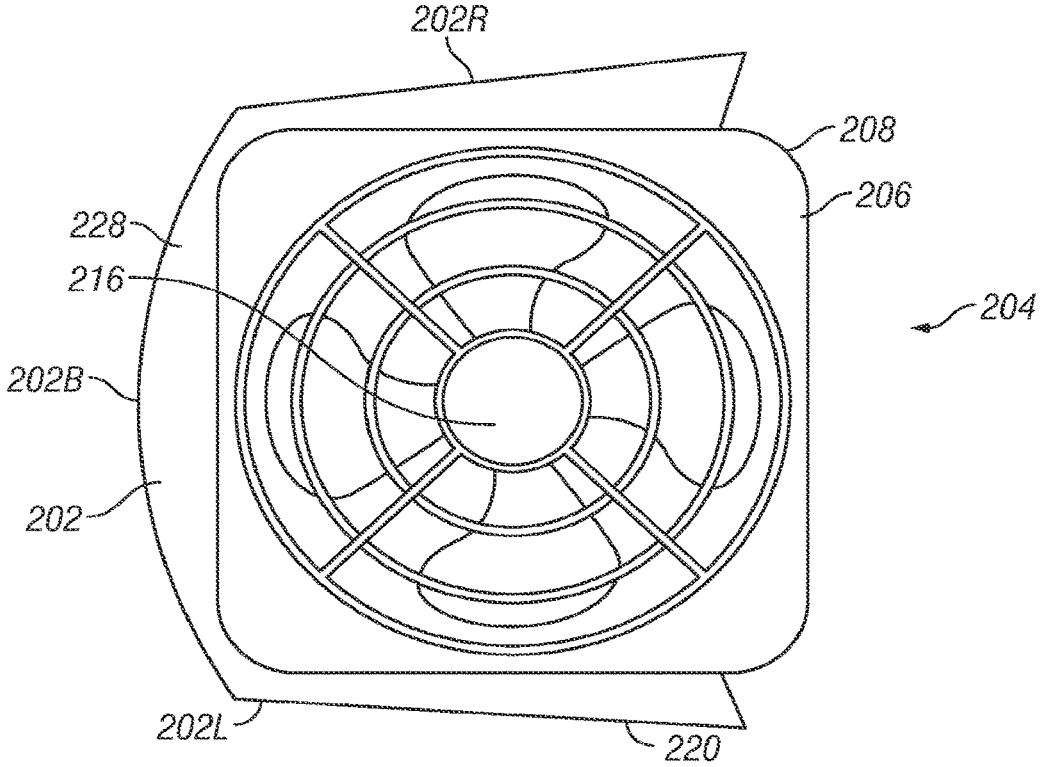
FIG. 4 is a top plan view of the compressor unit of FIGS. 2-3.
Figure 5:
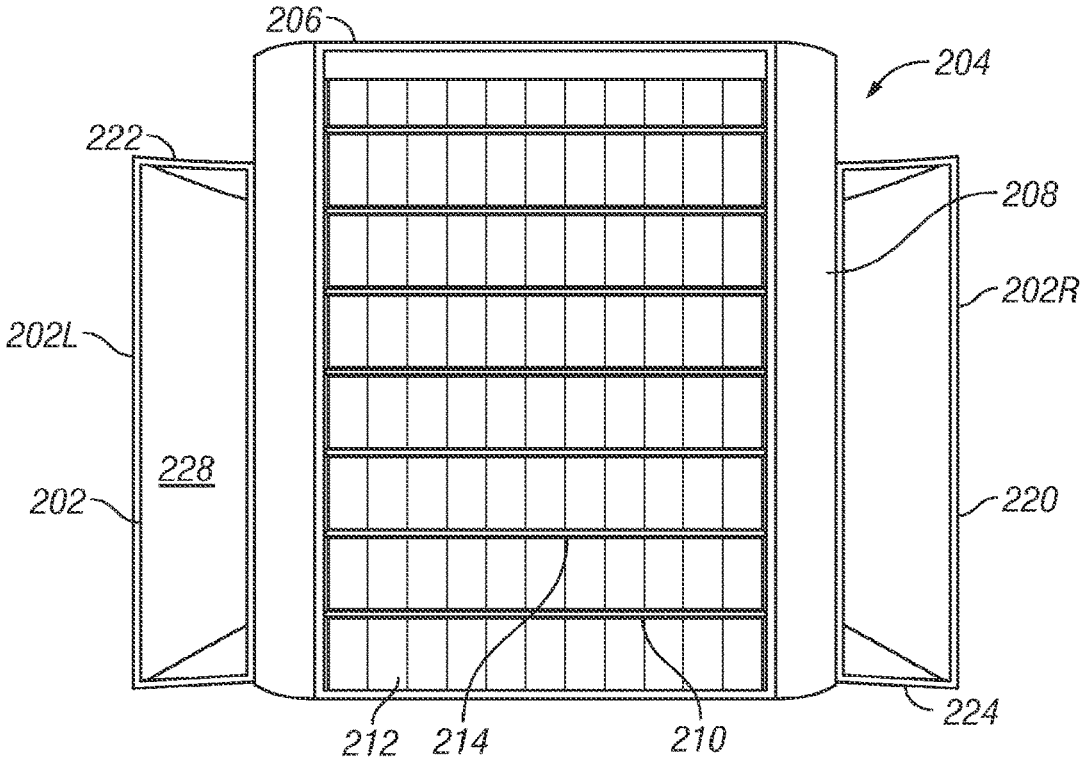
FIG. 5 is a front elevation view of the compressor unit of FIGS. 2-4.
Figure 6:
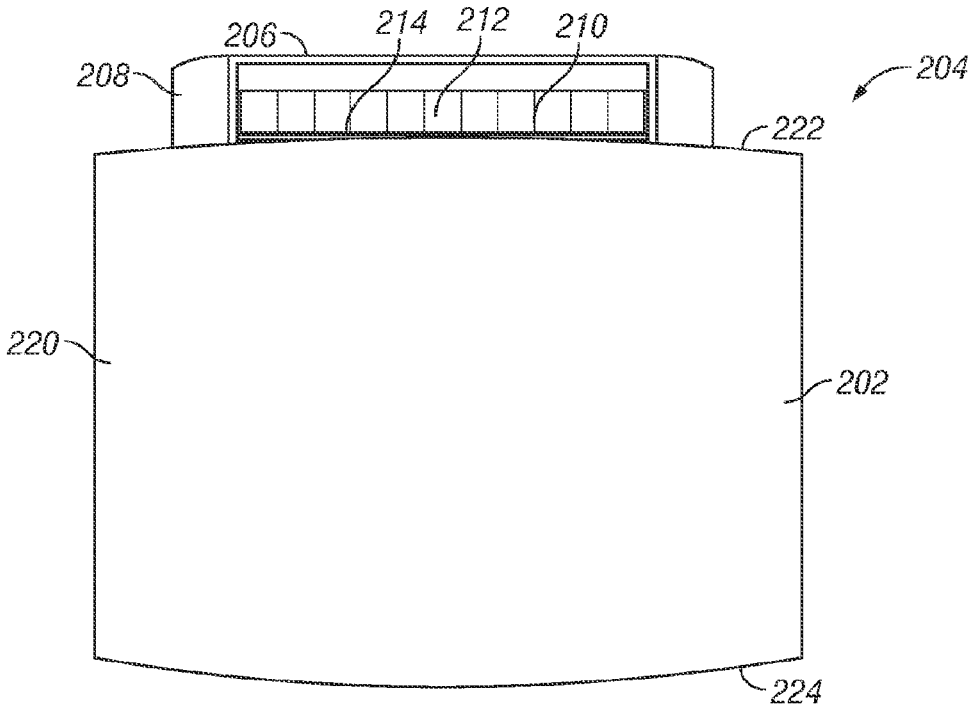
FIG. 6 is a rear elevation view of the compressor unit of FIGS. 2-5.

Referring now to FIG. 1, the outdoor compressor unit (CU) 108 comprises an inlet air flow guide 200 according to one embodiment of the invention. The flow guide 200 acts as a plenum draws and accelerates cooler air from the front of the CU 108 to be passed across at least a portion of the coil 116, or can be oriented in another direction so as to minimize or avoid re-feeding hot exhaust air. The flow guide 200 acts as a baffle to inhibit re-entry of hot exhaust air from adjacent the compressor unit, e.g., from a nearby unit.

The inlet air flow guide 200 may increase the efficiency of an HVAC condenser unit 108 by forcing cooler air across the refrigerant coils, especially across the back panel of the unit, which typically is the hottest panel. The inlet air flow guide 200 may thus decrease the cumulative daily run-time of the condenser unit. This is accomplished by providing ducted relatively cooler fresh air to the unit panels for supply air. The heated air from the coil 116 also provides additional lift under the blades of the fan 114, which reduces the work of the fan, thus the fan motor draws less current. All these features reduce the power demand side of HVAC operations related energy consumption. The inlet air flow guide 200 thus provides the home or business owner real monthly savings, by reducing the energy requirements for operation.

FIGS. 2-6 illustrate an embodiment of the inlet air flow guide 202 for a compressor unit 204 having a housing 206 in a generally square plan with upright supports 208 at the corners and grates 210 on the sides. The condenser coil 212 is disposed behind the grates 212 in the housing 206 and is protected behind grate members 214 which form louvers to allow cooling air to freely enter the housing 206. Air entering the housing 206 is warmed as it travels through the coil 212 and is discharged upwardly via fan 216.

The flow guide 202 comprises a generally imperforate upright wall 220 laterally spaced from the housing 206, a ceiling member 222 extending from the wall 220 to the housing 206 at the top and a similarly extending floor member 224 at the bottom, thus creating a plenum 228 for the entry of cooling air. The plenum 228 should have a sufficient width so as not to excessively impede air flow into the housing. The flow guide 202 in this embodiment has three sides 202L, 202R, 202B opposite the left, right and the back of the housing 206, leaving the front side uncovered. In an embodiment, one or more of the sides has a concave interior or convex exterior, e.g., the back side 202B.

Preferably the flow guide 202 is positioned so that the open side corresponds to the side which is generally directed away from warm air or warm air currents at a higher temperature than ambient, such as may occur facing adjacent building walls and/or adjacent units. The ceiling member 222 and especially the floor member 224 are optional if there is an abutting structure such as grade or a concrete pad. The inlet air flow guide 202 to have the same height as the coil 212, as a small portion such as less than 20%, less than 10% or less than 5% of the exposed surface area of the side of the coil 212 may be outside the area covered by the guide 202, for the sides where the flow guide 202 is disposed.

The inlet air flow guide 202 may be constructed of any suitable material such as sheet metal or a thermoplastic film or sheet, or a composite. The guide 202 may be secured to the housing 206 by straps, bolts, adhesive, and the like. Conveniently, especially in retrofit applications, an elastomeric tie down strap can secure the guide 202 in place by attaching either end of the strap to the housing 206.

Figure 7:
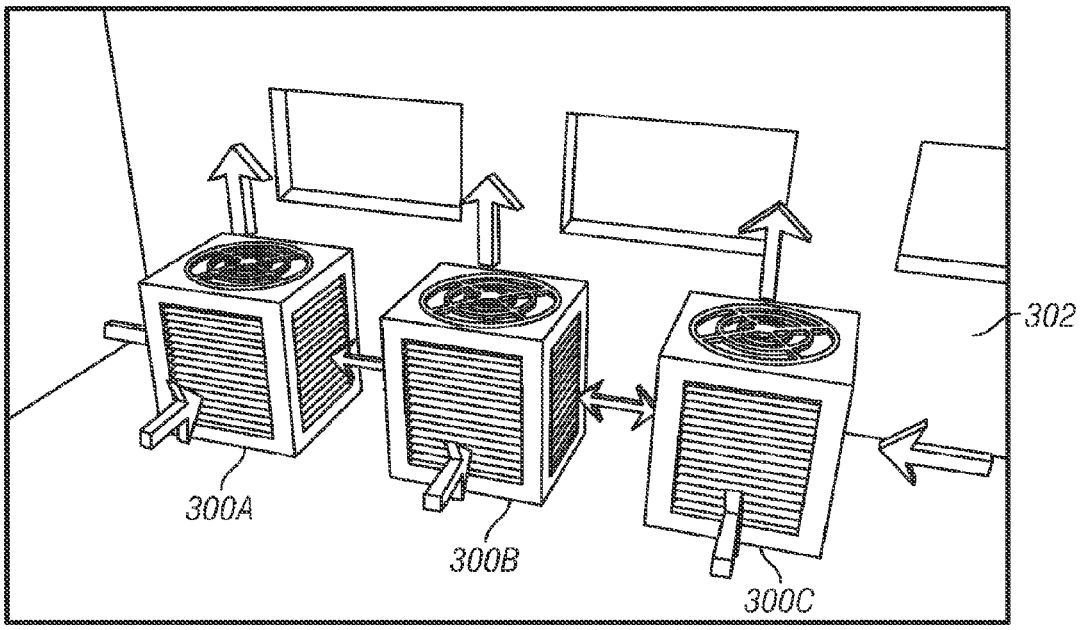
FIG. 7 (Prior Art)
FIG. 7 is a schematic diagram of a (prior art) multiple unit install.

FIG. 7 illustrates a common installation at many sites: the HVAC condenser units 300A, 300B, 300C are set too close together and too close to the building wall 302, and therefore these units will draw in hotter-than-ambient cooling air including hot exhaust air from the same and/or different units, causing the condensers to run harder and longer to cool the refrigerant, using more power and possibly shortening the life of the condenser and/or the condenser components.

Figure 8:
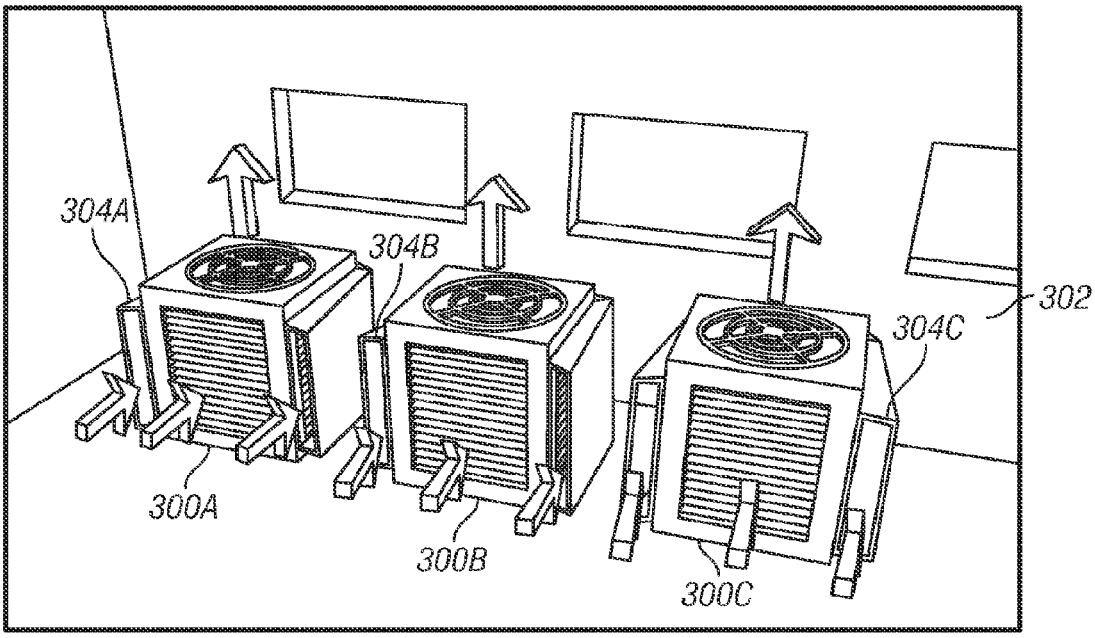
FIG. 8 is a schematic diagram of the multiple unit install of FIG. 7 wherein the units incorporate an inlet air flow router according to an embodiment of the invention.

In FIG. 8, the condenser units 300A, 300B, 300C are retrofitted with the inlet air flow guides 304A, 304B, 304C oriented such that most or at least a majority of the cooling air is drawn from the front of the units and away from the adjacent unit(s) and the wall 302. In an embodiment where the inlet air flow guides 304A, 304B, 304C are provided as original equipment in the condenser units 300A, 300B, 300C, the guides serve to maintain a plenum for the cooling air to reach all areas of the coil, facilitating appropriate unit spacing in the install.

Figure 9:
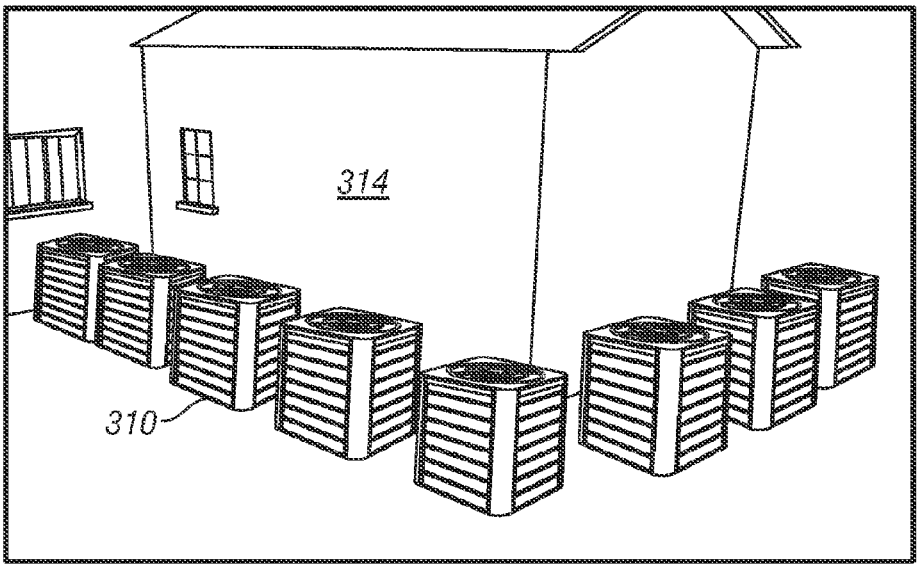
FIG. 9 (Prior Art)
FIG. 9 is a schematic diagram of another (prior art) multiple unit install.
Figure 10:
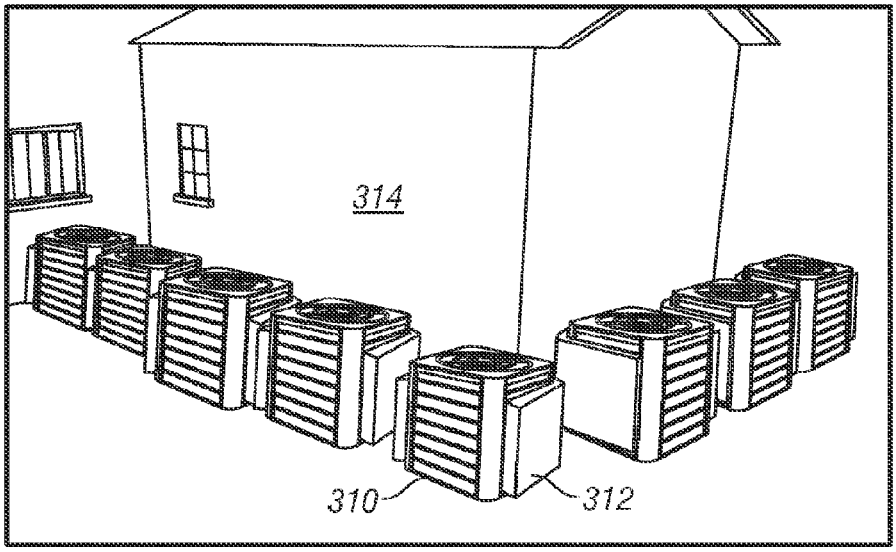
FIG. 10 is a schematic diagram of the multiple unit install of FIG. 9 wherein the units incorporate an inlet air flow router according to an embodiment of the invention.

FIG. 9 illustrates another installation with many closely spaced condenser units 310, and FIG. 10 a retrofit with inlet air flow guides 312 installed with intake oriented away from the adjacent unit(s) and away from the wall 314 behind the units.

Figure 11:
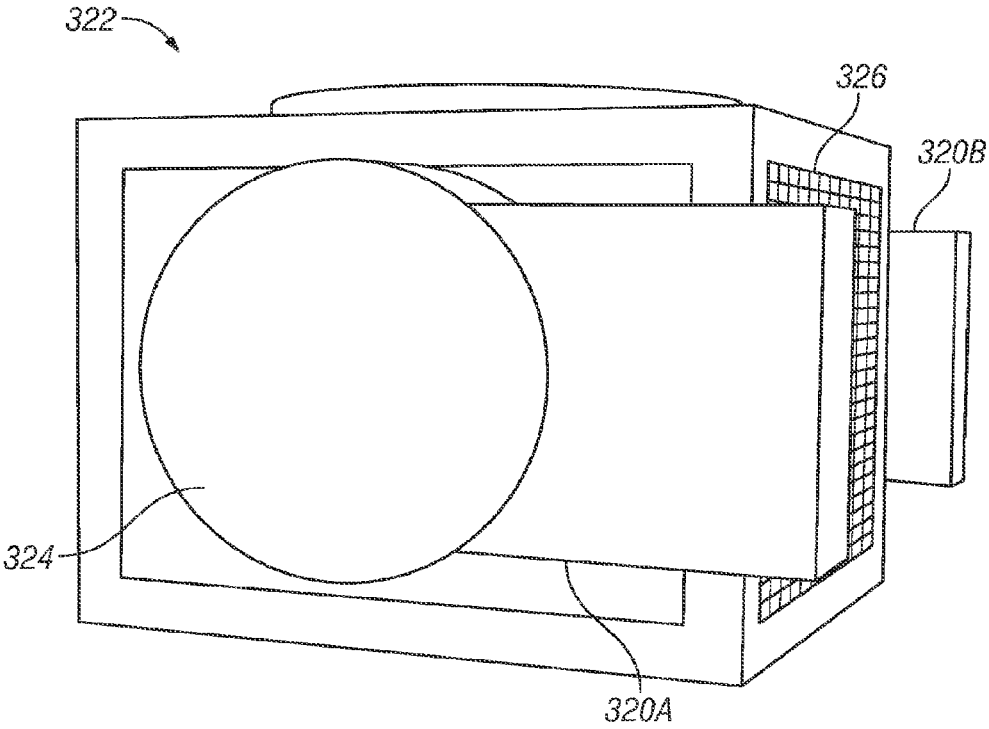
FIG. 11 is a perspective view of the compressor unit of an ACDX unit incorporating an alternate embodiment of an inlet air flow router.

FIG. 11 is another embodiment of the inlet air flow guides 320A, 320B installed on either side of the unit 322, which may be a condenser unit of a split ACDX system, or a package unit. The guides 320A, 320B each have a main profile 324 matching that of the louvers or other cooling air inlet area of the condenser cooling coil, in this case circular, and a duct extending from the main profile to the front face 326 of the unit 322, or beyond the face 326, e.g., at least 1 width, preferably 2 or 3 widths, of the duct beyond the face 326. The extension of the vertical walls of the guides 320A, 320B further provides a channel between the guides to inhibit air entry from the side, which may be warmer than ambient, and facilitate drawing the air from the region opposite the face 326. This embodiment is preferred where the unit 322 is original equipment since the guides 320A, 320B can be formed integral with the side wall of the housing, or preferably of unitary construction therewith.

Figure 12:
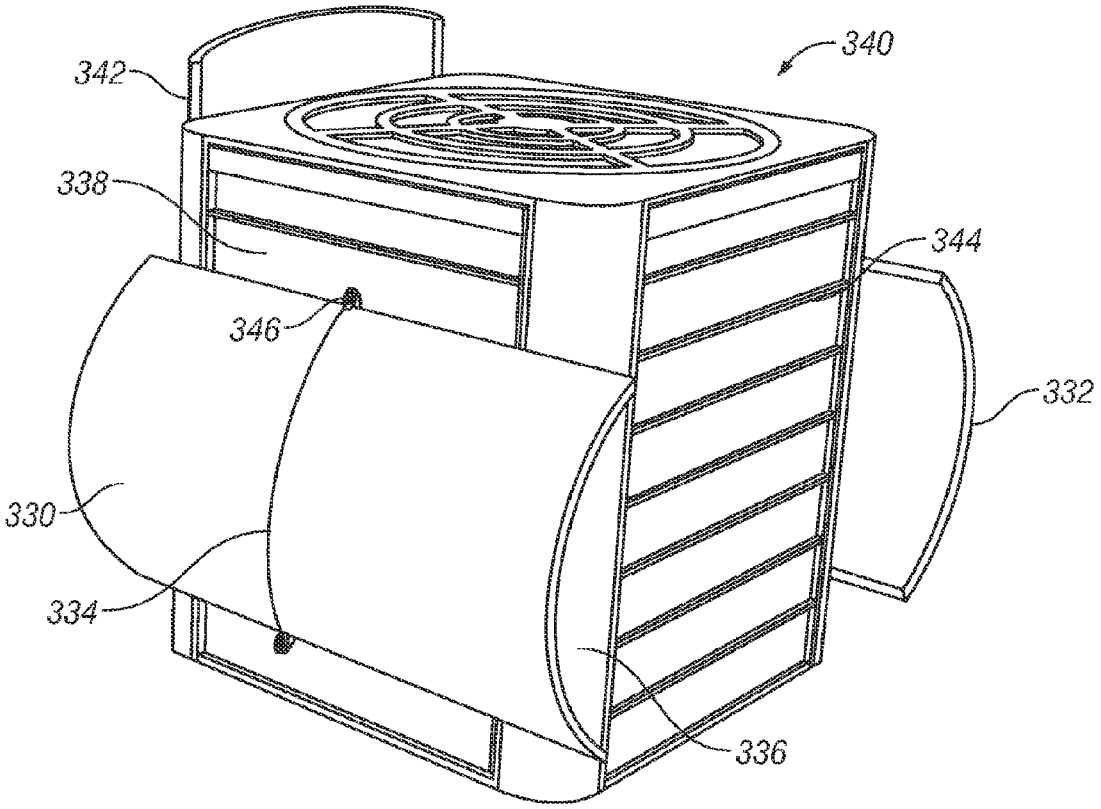
FIG. 12 is a perspective view of the compressor unit of an ACDX unit incorporating a further alternate embodiment of an inlet air flow router.

FIG. 12 illustrates another embodiment of an inlet air flow guide 330 provided in the form of a convex panel 332 secured via rubber tie down strap 334, wherein the cooling air plenum 336 is defined by the convexity of the panel 332 and the side face 338 of the unit 340. In this embodiment, the panel 332 preferably has at least one dimension longer than a corresponding dimension of the side face 338 so as to extend beyond the end of the unit 340 in one direction where air is drawn preferentially from a direction where more favorable air temperatures prevail. If desired the guides on the sides may be oriented with a generally horizontal plenum, and a guide on the rear of the unit between the sides, if used, may have a generally vertical plenum. Alternatively, the rear guide 342 may also be oriented horizontally, and in one embodiment the rear guide may also be provided with an end curvature to match the profile of the side guide panels, each of the side guide panels may have a curvature matching the rear guide panel, and/or both the side and rear guide panels may have matching profiles (as in a miter joint), to provide a continuous plenum around the sides and rear of the unit.

In one embodiment the guide 330 is applied as a retrofit wherein the panel is provided as a flat sheet having resilience in at least one direction permitting an originally flat panel 332 to be curved by pushing the opposite sides together, which can be effected by securing the tie down strap 334 to louvers 344 with hooks 346 to maintain the convexity. Alternatively the hooks 346 can be secured directly to the edge of the panel 346. The panel 332 can be, for example, a polyethylene sheet that is shipped and distributed flat, cut to size on location if desired and curved upon installation. The convexity also provides longitudinal rigidity.

Figure 13:
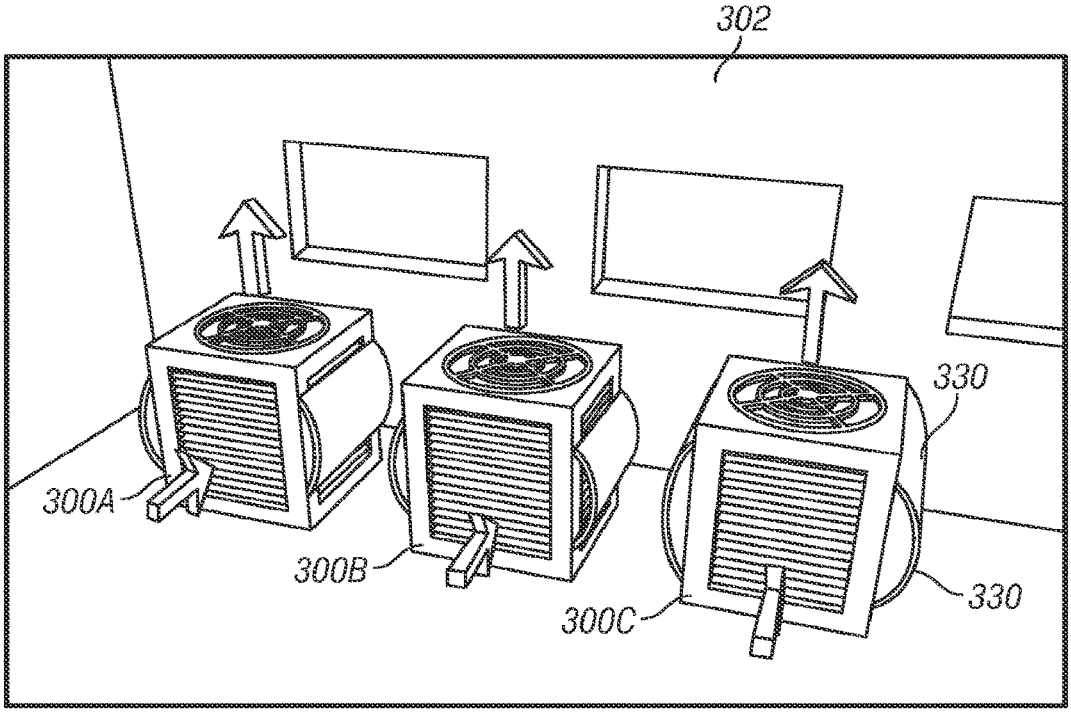
FIG. 13 is a schematic diagram of the multiple unit install of FIG. 7 wherein the units incorporate an inlet air flow router according to the embodiment of FIG. 12.

FIG. 13 shows an install where the inlet air flow guides 330 from FIG. 12 are used in the crowded install of FIG. 7. In this embodiment, the guides 330 function as baffles to inhibit warm exhaust air from an adjacent unit from mixing into cooling air at the intake. The end of the guide 330, if the geometry allows, can be extended to abut the wall 302 which cooperates to draw at least a portion of the air to the rear intake of the unit via the plenum defined by a side guide.

Accordingly the invention provides the following embodiments:

A. An inlet air flow guide for a condensing unit of an air cooled direct expansion air conditioning unit, comprising:
   a panel having at least a portion spaced from a surface of the condensing unit to define a plenum for cooling air to enter the condensing unit from one side.

B. The inlet air flow guide of Embodiment A wherein the condensing unit has a rectangular plan with refrigerant cooling coils at four sides and wherein the inlet air flow guide is secured to the unit at three sides and the remaining side is open.

C. The inlet air flow guide of Embodiment A or Embodiment B wherein the plenum is U-shaped.

D. The inlet air flow guide of any one of Embodiment A to Embodiment C wherein the plenum comprises intake openings at opposite ends adjacent the open side of the condensing unit.

E. The inlet air flow guide of any one of Embodiment A to Embodiment D comprising a ceiling, a floor or a combination thereof between the top and bottom, respectively of a generally vertical panel and the surface of the condensing unit.

F. The inlet air flow guide of any one of Embodiment A to Embodiment E comprising a convex panel.

G. The inlet air flow guide of any one of Embodiment A to Embodiment F in a condensing unit of an air cooled direct expansion air conditioning unit.

H. A condensing unit of an air cooled direct expansion air conditioning unit, comprising:
a housing;
a refrigerant cooling coil disposed in an opening of the housing;
an exhaust fan to draw air through the opening across the coil and discharge the air above the housing;
an inlet air flow guide defining a plenum to provide an air flow passage to the opening from one side thereof.

I. The condensing unit of Embodiment H wherein the housing is circular.

J. The condensing unit of Embodiment H wherein the housing has four sides each with refrigerant coil disposed in a respective louvered opening thereof, and wherein the plenum is in fluid communication with the louvered openings at a plurality of the sides.

K. The condensing unit of Embodiment J wherein the plenum is U-shaped to supply cooling air to three of the sides and comprises inlet air openings at either end adjacent to the fourth side.

L. The condensing unit of any one of Embodiment H to Embodiment K wherein the plenum comprises a generally vertical wall having a top and bottom spaced opposite the opening, and one or both of a ceiling and a floor extending from the respective top or bottom to the housing.

M. The condensing unit of Embodiment L wherein the plenum wall has a height less than a height of the housing and the ceiling and floor, if present, are spaced below and above upper and lower ends of the housing, respectively.

N. The condensing unit of any one of Embodiment H to Embodiment M wherein the plenum partially covers the opening.

O. A method, comprising installing the air flow guide of any one of Embodiment A to Embodiment F onto a condensing unit of an air cooled direct expansion air conditioning unit for cooling air to enter the condensing unit from one side.

P. A method, comprising:
installing an inlet air flow guide onto a condensing unit of an air cooled direct expansion air conditioning unit, wherein the inlet air flow guide comprises a panel having at least a portion spaced from a surface of the condensing unit to define a plenum for cooling air to enter the condensing unit from one side.

Q. The method of Embodiment O or Embodiment P wherein the condensing unit is located where air flow to the condensing unit is restricted and wherein the inlet air flow guide installation improves the cooling air flow to the condensing unit.

R. The method of any one of Embodiment O to Embodiment Q wherein, prior to the installation, the condensing unit is situated to recirculate relatively hot exhaust air to enter the condensing unit, and the installation of the inlet air flow guide inhibits the recirculation to lower the temperature of the cooling air entering the condensing unit.

S. The method of any one of Embodiment O to Embodiment R wherein the condensing unit is a first one of first and second condenser units situated with the second condensing unit opposite the surface of the first condensing unit, whereby the inlet air flow guide is installed opposite the second condensing unit.

T. The method of Embodiment S further comprising installing a said air flow guide on a surface of the second condensing unit opposite the first condensing unit.

U. The method of any one of Embodiment O to Embodiment T wherein the condensing unit is one of a plurality of condensing units situated near each other and a like plurality of the inlet air flow guides is installed on the plurality of condensing units.

V. The method of Embodiment U wherein the inlet air flow guides are installed on opposing surfaces of adjacent condensing units.

EXAMPLE 1

An inlet air flow guide according to the present invention is installed in a typical 8.8 kw (2.5 refrigeration tons) split ACDX unit averaging 550 kwh/month running about 6 hours/day. The inlet air flow guide reduces run time about 2 to 5% or 7 to 19 minutes per day, the equivalent of 11-22 kwh per month per unit.

EXAMPLE 2

A 215 square meter (2300 square feet) residence in Houston, Tex., is cooled with a single 17.6 kw (5 ton) split ACDX unit with a monthly power consumption of 1200 kwh/month (average 6 hours/day). Installing an inlet air flow guide according to the present invention reduces energy consumption by 4% to 1152 kwh/month.

The inlet air flow guides of the present invention have numerous advantages in addition to energy savings from providing cooling air with a favorable thermal condition. For example, the flow guides may serve as spacing templates to ensure that the condensing units are installed with sufficient spacing from adjacent units and structures so as to avoid blocking the cooling air supply. The air flow guides may also protect the cooling coils from fouling with dirt, vegetation growth and debris, etc. The flow guides may shade the cooling coils from insolation.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

I claim:

1. An inlet air flow router for a condenser unit of an air cooled direct expansion air conditioning unit comprising an evaporator coil disposed in an air handling unit for cooling one or more rooms inside a building and a refrigerant cooling coil located external to the building being cooled, disposed within a unit housing comprising a front face and a plurality of sides, behind a fenestration disposed in at least one of a plurality of side upright housing panels of the unit housing, and a top mounted exhaust fan disposed below an upper surface of the unit housing which draws outside cooling air into the unit housing through the fenestration and through the refrigerant cooling coil and discharges exhaust air from the unit housing as an upward exhaust stream, comprising:

a horizontal cooling air plenum formed by spacing an imperforate upright wall panel outwardly from one of the side upright housing panels and connecting the imperforate upright wall panel at a top and bottom thereof to the side upright housing panel forming a continuous cooling air flow path between the fenestration and a plenum opening arranged parallel to the front face of the condensing unit located at an end of the horizontal plenum proximate to the front face, such that the top mounted exhaust fan draws outside cooling air through the plenum opening and along the cooling air flow path of the cooling air plenum and into the unit housing through the fenestration then through the refrigerant cooling coil to then be discharged as exhaust air from the unit housing as an upward exhaust stream;

the inlet air flow router being installable onto at least one of the plurality of side upright housing panels of the unit housing to at least partially cover the fenestration.

2. The inlet air flow router of claim 1, wherein the unit housing has a rectangular plan with refrigerant cooling coils at three sides and the front face, and wherein the inlet air flow router is secured to the unit housing at the three sides and the front face is open.

3. The inlet air flow router of claim 2 wherein the horizontal plenum is U-shaped in plan.

4. The inlet air flow router of claim 2, wherein the horizontal plenum comprises two plenum openings, each located at opposite ends proximate to the front face.

5. The inlet air flow router of claim 1, further comprising a ceiling member, a floor member or a combination thereof extending between the top and bottom, respectively of the imperforate upright wall panel and the side upright housing panel of the unit housing to connect the inlet air flow router to the unit housing.

6. The inlet air flow router of claim 1, wherein the imperforate upright wall panel is convex.

7. The inlet air flow router of claim 1, wherein the inlet air flow router is dimensioned and arranged to be installable onto, and in contact with at least one of the plurality of side upright housing panels of the unit housing such that the cycle time of the condenser unit is reduced compared to the cycle time of the same condenser unit operated under essentially identical conditions in the absence of the inlet air flow router.

8. The inlet air flow router of claim 1, wherein the inlet airflow router is formed integral with at least one of the side upright housing panels.

9. The inlet air flow router of claim 1, dimensioned and arranged to be installable onto at least one of the plurality of side upright housing panels of the unit housing to inhibit air entry into the unit housing from a side of the condenser unit such that air is drawn into the unit housing through the plenum opening from a region opposite the front face of the condenser unit.

10. The inlet air flow router of claim 1, dimensioned and arranged to be installable onto at least one of the plurality of side upright housing panels of the unit housing such that a portion of the imperforate upright wall panel extends beyond the front face of the unit housing.

11. The inlet air flow router of claim 1, dimensioned and arranged to be secured onto at least one of the plurality of side upright housing panels of the unit housing using straps, bolts, adhesives, elastomeric tie down straps, hooks, or a combination thereof.

* * * * *